US007438092B2

(12) United States Patent
Wahhoud

(10) Patent No.: US 7,438,092 B2
(45) Date of Patent: Oct. 21, 2008

(54) POWER LOOM, PARTICULARLY AN AIR JET POWER LOOM, FOR THE PRODUCTION OF A LENO FABRIC WITH INTEGRAL PATTERNING

(75) Inventor: Adnan Wahhoud, Lindau-Bodolz (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 11/632,355

(22) PCT Filed: Jun. 9, 2005

(86) PCT No.: PCT/DE2005/001020

§ 371 (c)(1),
(2), (4) Date: Jan. 11, 2007

(87) PCT Pub. No.: WO2006/007805

PCT Pub. Date: Jan. 26, 2006

(65) Prior Publication Data

US 2007/0295423 A1 Dec. 27, 2007

(30) Foreign Application Priority Data

Jul. 16, 2004 (DE) ..... 10 2004 034 605

(51) Int. Cl.
*D03D 7/00* (2006.01)
*D03D 7/08* (2006.01)
*D03D 51/02* (2006.01)

(52) U.S. Cl. ..... 139/50; 139/1 E; 139/52; 139/53; 139/54

(58) Field of Classification Search ..... 139/1 E, 139/50, 52, 53, 54
See application file for complete search history.

(56) References Cited

U.S. PATENT DOCUMENTS

| | | | | |
|---|---|---|---|---|
| 4,429,722 | A | 2/1984 | Herzog | |
| 5,582,213 | A | 12/1996 | Okawa | |
| 6,092,559 | A * | 7/2000 | Dvorak et al. | 139/50 |
| 6,311,737 | B2 * | 11/2001 | Wahhoud et al. | 139/50 |
| 6,315,008 | B2 * | 11/2001 | Dornier et al. | 139/50 |
| 6,382,262 | B1 * | 5/2002 | Herzig | 139/50 |
| 6,386,241 | B1 * | 5/2002 | Griffith | 139/192 |
| 7,073,537 | B2 * | 7/2006 | Wahhoud et al. | 139/50 |

FOREIGN PATENT DOCUMENTS

| | | |
|---|---|---|
| DE | 101 28 538 | 1/2003 |
| DE | 103 07 489 | 11/2004 |
| EP | 1 262 584 | 12/2002 |
| WO | WO 02101131 A2 * | 12/2002 |

* cited by examiner

*Primary Examiner*—Bobby H Muromoto, Jr.
(74) *Attorney, Agent, or Firm*—W. F. Fasse; W. G. Fasse

(57) ABSTRACT

A loom, especially an air jet loom for producing a leno cloth with integrated patterning includes a weaving reed and first and second shed forming devices. The first shed forming device includes a pivotable reed as a first guide arrangement for guiding and shedding leno warp threads, and an upright reed as a second guide arrangement for guiding and shedding ground warp threads, to form leno bindings. The second shed forming device includes a third guide arrangement for guiding and shedding patterning warp threads, to form pattern bindings. The third guide arrangement is arranged between the first shed forming device and the weaving reed.

20 Claims, 1 Drawing Sheet

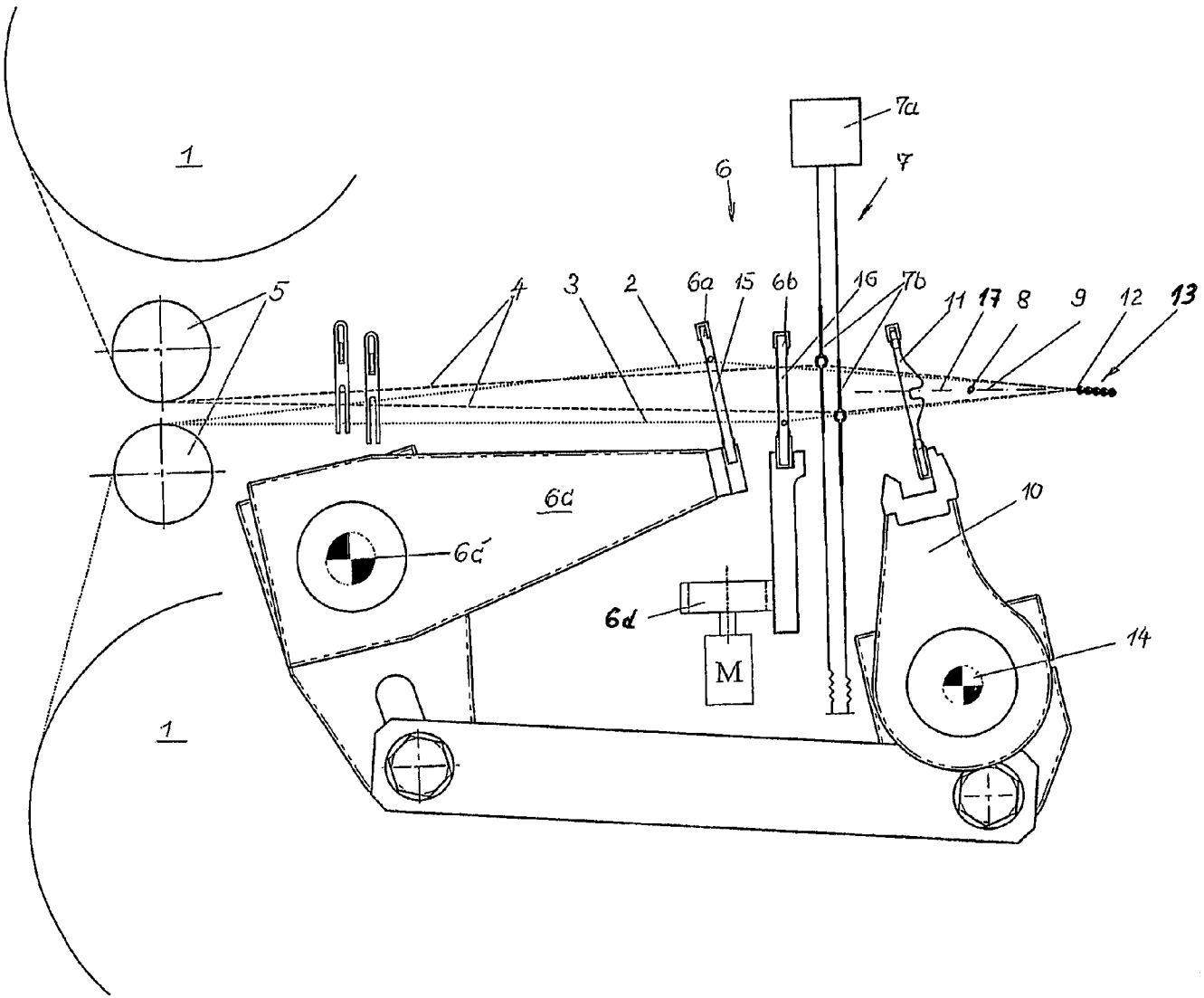
13
12
9
8
17
11
7b
16
7a
7
6b
15
6
6a
2
3
4
5
1
10
14
6d
M
6c
6c'
1

POWER LOOM, PARTICULARLY AN AIR JET POWER LOOM, FOR THE PRODUCTION OF A LENO FABRIC WITH INTEGRAL PATTERNING

FIELD OF THE INVENTION

The invention relates to a weaving machine or power loom, especially an air jet loom for producing a leno cloth with integral patterning.

BACKGROUND INFORMATION

A method for producing woven webs or cloths is known from the U.S. Pat. No. 4,429,722, according to which a pattern can be formed in the woven cloth simultaneously during the normal woven cloth formation, for example of a linen weave cloth. In order to be able to produce such a woven cloth, the U.S. Pat. No. 4,429,722 discloses a weaving machine or loom with at least one means for holding or presenting a first type of warp threads and for holding or presenting a second type of warp threads. The warp threads of the first type are yarns as are used for leno weave cloths, while the warp threads of the second type are so-called decorative warp threads. Furthermore, suitable means are provided to deflect the totality of the warp threads supplied by the holding or presenting means in the direction of shed forming devices, whereby a first shed forming device effectuates the formation of so-called leno bindings or weaves in the woven cloth, while the second shed forming device serves for the pattern formation in the leno weave cloth. The known apparatus further has means for the insertion of a weft thread into the sheds formed of the above mentioned warp threads. Finally the known loom comprises a sley with a weaving reed, as means for beating-up the weft thread against the binding or interlacing point of the woven cloth to be produced. The shed formation with the leno weave warp threads requires, in the previously known loom, a costly shed forming machine as well as costly means for the lateral movement of the needle shafts or healds effectuating the leno binding. Moreover, as is generally known, the productivity of such looms is not satisfactory, that is to say the operating rotational speeds lie under 400 per minute, due to the complexity of the motion sequences in the means effectuating the shed formation.

SUMMARY OF THE INVENTION

It is the underlying object of the invention to provide a weaving machine or loom on which a leno cloth with integral patterning, for example a Jacquard or heald patterning, can be produced, with an operating rotational speed of the loom of more than 400 per minute.

The object is achieved according to the invention in that a first device for the formation of leno bindings is provided, which comprises a first leno shed forming guide means for leno threads and a second leno shed forming guide means for ground threads. The first leno shed forming guide means is connected, in a per se known manner, with a drive transmission means, of which the drive is derived from the drive means of the sley. The second leno shed forming guide means is operatively connected, in a per se known manner, with at least one further drive transmission means, in such a manner so that it carries out a short-stroke back-and-forth motion perpendicularly to the warp threads in a prescribed arrangement plane, preferably in the weaving plane, and thereby effectuates the forming of a leno binding in synchronous operation with the first guide means. For the formation of a patterning in the leno cloth, according to the invention there is provided a second device with shed forming means for the guiding of patterning threads, which shed forming means are arranged between the leno shed forming guide means of the first device and the weaving reed. In further embodiment of the invention, the first leno shed forming guide means is a comb or reed that is pivotably moveable about the rotation axis of the first drive transmission means and that guides the leno threads by means of needle and/or shoulder drop wires or lamellae, and the second guide means effectuating the leno binding is a comb or reed that guides the ground threads by means of needle and/or shoulder drop wires or lamellae and that carries out a short-stroke back-and-forth motion perpendicularly to the warp threads in an arrangement plane, preferably in the weaving plane, after the first leno shed forming guide means as seen in the direction toward the woven cloth to be formed. In that regard, the shed forming means for the formation of the patterning in the leno cloth can be at least two conventional heald frames containing heddles, which are connected with a suitable drive means for the shed formation; it can further be a known Jacquard arrangement with harness cords and heddles, through the heddle eyelets of which at least one patterning thread is guided.

For forming the patterning, according to the invention, also at least one first and one second heald frame can be provided, in which heald frame, heald frame rods in the manner of heddles are received, and whereby preferably each heald frame rod has such a provision so that at least one patterning thread can be leased into the provision. In that regard, each heald frame rod comprising the provision is operatively connected with a controlledly actuatable adjusting or positioning drive for the position change of the provision within the applicable heald frame.

In further embodiment of the invention, the suitable drive of the means guiding the patterning threads and forming the shed can selectively be a drive derived from a main drive of the loom, or the shed forming means are operatively connected with a drive independent from the main drive of the loom.

BRIEF DESCRIPTION OF THE DRAWING

In the following, the invention shall be explained in further detail in connection with an example embodiment that is schematically shown in a side view in the accompanying single drawing FIGURE.

DETAILED DESCRIPTION OF AN EXAMPLE EMBODIMENT OF THE INVENTION

A weaving machine or loom embodied according to the invention is schematically illustrated in the accompanying FIGURE. A first warp beam 1 supplies leno threads 2 and ground threads 3 to a first shed forming device 6. For their deflection before they reach the shed forming device 6, the leno threads 2 and ground threads 3 are guided over a means embodied as a backrest beam or roller 5. The shed forming device 6 consists of a pivotable reed embodied as guide means **6*a* for the leno threads 2, with a plurality of so-called needle or shoulder drop wires or lamellae as is known from the DE Patent 103 07 489 B3. In that regard, each leno thread 2 can be guided through an eyelet of the corresponding needle drop wire 15 or by the shoulder of a so-called shoulder drop wire 15. In the direction toward the woven web or cloth 13 to be formed, the leno threads 2 pass a guide means 6*b* embodied as a standing or upright reed, which has a plurality of above-mentioned needle or shoulder drop wires or lamellae like the pivotable reed. The leno threads 2 additionally pass shed forming means in which pattern threads 4 are guided. Finally the leno threads 2 pass the weaving reed 11 before they are guided or brought together with the ground and pattern threads in the binding or interlacing point 12 of the woven cloth 13**.

With regard to the ground threads 3, each one of these threads, after its direction deflection by the backrest beam 5, is guided into the free space present between two neighboring needle or shoulder drop wires 15 of the pivotable reed 6*a*, and is received, for example, in an eyelet of the needle drop wire of the standing or upright reed. Then, the ground threads 3 pass the additional shed forming means 7*b* and the weaving reed 11, without the ground threads 3 experiencing any impairment of their orientation toward the interlacing point 12 of the woven cloth 13 by the shed forming means 7*b* and the weaving reed 11. The formation of a leno weave cloth with the means of a pivotable reed 6*a* and a standing or upright reed 6*b* are known from the DE 101 28 538 A1, so that further explanations will be omitted here.

For the formation of an integral patterning in a leno weave cloth that is to be produced, the loom has a second warp beam 1, which is a so-called upper warp beam, and which upper warp beam, according to the invention, supplies the pattern warp threads 4 to the second shed forming device 7 arranged between the leno shed forming means 6*b* of the first device 6 and the weaving reed 11. The second shed forming device 7 in the present example embodiment is a Jacquard arrangement with a drive 7*a* that is independent from or dependent on the loom, as is known per se.

As becomes clear from the above disclosure and the description, the essence of the present invention is that the production of leno weave cloth with integral patterning is thereby made possible if further shed forming means in the manner of heald frames containing heddles, which are connected with a suitable drive means, are allocated, or a known Jacquard arrangement with harness cords and heddles is allocated, to the shed forming means of the loom known from DE 101 28 538 A1 for the production of a leno cloth.

The invention claimed is:

1. Loom for the production of a leno cloth with integral patterning, comprising a) at least one means for presenting or holding leno threads (2) and ground threads (3) as a first type of warp threads and for presenting or holding patterning threads (4) as at least a second type of warp threads, b) suitable means for the deflection of the totality of the warp threads in the direction toward first and second shed forming devices (6,7), whereby b1) the first shed forming device (6) effectuates the formation of leno bindings, and b2) the second shed forming device (7) effectuates the formation of a binding different from the leno bindings, c) means for the insertion of a weft thread (8) into the shed (9), and d) a sley (10) with a weaving reed (11) as means for the beating-up of the weft thread against the interlacing point (12) of the cloth (13) to be produced, characterized in that the first shed forming device (6) comprises a first leno shed forming guide means (6*a*) which is operatively connected with drive transmission means (6*c*), and which drive transmission means (6*c*) is operatively connected with a drive means (14) of the sley (10), characterized in that the first shed forming device further comprises a second leno shed forming guide means (6*b*) which is operatively connected with at least one further drive transmission means (6*d*), characterized in that the second shed forming device (7) comprises further shed forming means, which are operatively connected with a suitable drive, and characterized in that the further shed forming means of the second shed forming device (7) are arranged between the second leno shed forming guide means (6*b*) of the first shed forming device (6) and the weaving reed (11).

2. Loom according to claim 1, characterized in that the first leno shed forming guide means (6*a*) is a reed that is pivotally moveable about a rotation axis (6*c*') of the drive transmission means (6*c*) and that guides the leno threads (2) by means of needle and/or shoulder drop wires (15), and in that the second leno shed forming guide means (6*b*) effectuating the leno binding is a reed guiding the ground threads (3) by means of needle and/or shoulder drop wires (16), which reed carries out a short-stroke back-and-forth motion perpendicular to the totality of the warp threads in the weaving plane (17).

3. Loom according to claim 1, characterized in that the further shed forming means of the second shed forming device (7) comprise at least one first and one second heald frame or shaft equipped with heddles.

4. Loom according to claim 1, characterized in that the further shed forming means of the second shed forming device (7) comprise a Jacquard arrangement with harness cords and heddles.

5. Loom according to claim 1, characterized in that the further shed forming means of the second shed forming device (7) comprise at least one first and one second heald frame respectively receiving heald frame rods in the manner of heddles, and wherein each heald frame rod has such a provision, that a patterning thread can be leased into the provision, and wherein each heald frame rod comprising the provision is operatively connected with a controlledly actuatable adjusting or positioning drive for the position changing of the provision within the applicable heald frame.

6. Loom according to claim 1, characterized in that the suitable drive of the further shed forming means of the second shed forming device is derived from a main drive of the loom.

7. Loom according to claim 1, characterized in that the suitable drive of the further shed forming means of the second shed forming device is at least one drive that is independent from a main drive of the loom.

8. Loom according to claim 1, wherein the loom is an air jet loom and the means for the insertion of the weft thread into the shed comprise air jet weft insertion means.

9. A loom for producing a leno weave cloth having integrated patterning, from ground warp threads, leno warp threads, patterning warp threads, and weft threads, wherein said loom comprises:

a leno shedding arrangement (6) that is adapted to form leno bindings of the ground warp threads (3) and the leno warp threads (2), and that comprises a first shedding guide arrangement (6*a*) adapted to receive, guide and move the leno warp threads, a second shedding guide arrangement (6*b*) adapted to receive, guide and move the ground warp threads, a first drive arrangement (6*c*) operatively connected to said first shedding guide arrangement, and a second drive arrangement (6*d*) operatively connected to said second shedding guide arrangement;

a pattern shedding arrangement (7) that is adapted to form pattern bindings, which are different from the leno bindings, of the patterning warp threads (4) relative to the ground warp threads and the leno warp threads, and that comprises a third shedding guide arrangement (7*b*)

adapted to receive, guide and move the patterning warp threads, and a third drive arrangement (7*a*) operatively connected to said third shedding guide arrangement;

a weft insertion device arranged and adapted to insert the weft threads (8) successively into open warp sheds formed of the warp threads by said leno shedding arrangement and said pattern shedding arrangement; and a sley (10) carrying a weaving reed (11) arranged and adapted to beat the weft threads successively against a beat-up interlacing point of the cloth being produced, and a sley drive arrangement (14) operatively connected to said sley;

wherein:

said first and second shedding guide arrangements driven respectively by said first and second drive arrangements are movable relative to one another in an up-down direction and in a lateral side-to-side direction so as to form the leno bindings; and said pattern shedding arrangement (7) is arranged between said leno shedding arrangement (6) and said weaving reed (11).

10. The loom according to claim 9, wherein said first drive arrangement (6*c*) is operatively coupled with said sley drive arrangement (14).

11. The loom according to claim 9, wherein said second drive arrangement (6*d*) is independent from said first drive arrangement (6*c*), said third drive arrangement (7*a*) and said sley drive arrangement (14).

12. The loom according to claim 9, wherein said first drive arrangement (6*c*) is arranged and adapted to move said first shedding guide arrangement (6*a*) at least in said up-down direction, and said second drive arrangement (6*d*) is arranged and adapted to move said second shedding guide arrangement (6*b*) at least in said lateral side-to-side direction.

13. The loom according to claim 9, wherein said first drive arrangement (6*c*) is a pivotal drive adapted to produce a pivoting motion about a pivot axis (6*c*'), said first shedding guide arrangement (6*a*) comprises a first shedding guide reed that is connected to said first drive arrangement so as to swing about said pivot axis and that comprises needle lamellae or shoulder lamellae through which the leno warp threads can be guided, said second drive arrangement (6*d*) is a reciprocating drive adapted to produce a reciprocating motion in said lateral side-to-side direction, and said second shedding guide arrangement (6*b*) comprises a second shedding guide reed that is connected to said second drive arrangement so as to move reciprocatingly with the reciprocating motion in said lateral side-to-side direction and that comprises needle lamellae or shoulder lamellae through which the ground warp threads can be guided.

14. The loom according to claim 9, further comprising a main loom drive, wherein said sley drive arrangement is operatively coupled with said main loom drive to be driven thereby, and said third drive arrangement (7*a*) is operatively coupled with said main loom drive to be driven thereby.

15. The loom according to claim 9, further comprising a main loom drive, wherein said sley drive arrangement is operatively coupled with said main loom drive to be driven thereby, and said third drive arrangement (7*a*) comprises an independent drive that is independent from said main loom drive.

16. The loom according to claim 9, wherein said third shedding guide arrangement (7*b*) comprises at least a first group of shedding elements adapted to receive, guide and move a first subset of the patterning warp threads, and a second group of shedding elements adapted to receive, guide and move a second subset of the patterning warp threads relative to and differently from said first group of shedding elements, and said third drive arrangement (7*a*) is arranged and adapted to move said first and second groups of shedding elements relative to one another in said up-down direction.

17. The loom according to claim 9, wherein said third shedding guide arrangement comprises first and second heald frames respectively equipped with heddles.

18. The loom according to claim 9, wherein said third shedding guide arrangement comprises a Jacquard arrangement with harness cords and heddles.

19. The loom according to claim 9, wherein said third shedding guide arrangement comprises first and second heald frames respectively carrying heddle rods having thread guides adapted to receive the patterning warp threads leased therein and to guide and move the patterning warp threads, and a respective positioning drive operatively connected to the heddle rods of each respective heald frame and adapted to change positions of said thread guides within said respective heald frame.

20. The loom according to claim 9, further comprising a first warp beam that supplies the ground warp threads and the leno warp threads, a second warp beam that supplies the patterning warp threads, a first backrest beam or roller arranged to deflect the ground warp threads and the leno warp threads from said first warp beam to said leno shedding arrangement, and a second backrest beam or roller arranged to deflect the patterning warp threads from said second warp beam to said pattern shedding arrangement.

* * * * *